US007748604B2

(12) United States Patent
Keefe, Jr. et al.

(10) Patent No.: US 7,748,604 B2
(45) Date of Patent: Jul. 6, 2010

(54) DISPLAY CONTAINER WITH AIR CELL PANEL ASSEMBLY AND ASSOCIATED CONTAINER BLANK

(75) Inventors: Walter D. Keefe, Jr., Carol Stream, IL (US); David J McKenna, Plainfield, IL (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 11/538,015

(22) Filed: Oct. 2, 2006

(65) Prior Publication Data

US 2008/0078822 A1 Apr. 3, 2008

(51) Int. Cl.
*B65D 5/18* (2006.01)
*B65D 5/50* (2006.01)

(52) U.S. Cl. ..... 229/167; 206/564; 229/164; 229/176

(58) Field of Classification Search ..... 229/164, 229/167, 172, 174, 176, 178; 206/485, 562, 206/563, 564, 565, 476, 485.1
See application file for complete search history.

(56) References Cited

U.S. PATENT DOCUMENTS 1,110,853 A * 9/1914 Wolfe ..... 229/167
2,064,191 A * 12/1936 Brooks ..... 229/172
2,334,985 A * 11/1943 Berry ..... 229/167
2,628,763 A * 2/1953 Frankenstein ..... 229/176
2,860,823 A * 11/1958 Frankenstein ..... 229/178
3,368,735 A * 2/1968 Levi ..... 229/167
3,450,347 A * 6/1969 Brom et al. ..... 229/176
3,499,597 A * 3/1970 Katzman ..... 229/167
4,146,127 A * 3/1979 Bayer ..... 206/485
4,570,787 A * 2/1986 Forbes, Jr. ..... 206/485
5,474,171 A * 12/1995 Niesen et al. ..... 229/172
6,474,473 B2 * 11/2002 Wong ..... 206/485
2007/0256952 A1 * 11/2007 Kim-Gifford et al. ..... 206/485

* cited by examiner

*Primary Examiner*—Gary E Elkins

(57) ABSTRACT

The embodiments of the present invention provide a blank foldable material that may be configured to form a container. When formed, the container is self-locking and includes air cell structure that allows for a container with a constant outside volume to have a variable inside volume. The air cell structure container functions to prevent telescoping of vertically stacked container and for strength and stability. The container may be partially assembled for shipping and hand set into final assembly as needed.

4 Claims, 4 Drawing Sheets

DISPLAY CONTAINER WITH AIR CELL PANEL ASSEMBLY AND ASSOCIATED CONTAINER BLANK

FIELD OF THE INVENTION

This invention relates generally to cellulose-based blanks and containers and more specifically, to wood cellulose-based blanks and containers used for storing and displaying goods.

BRIEF DESCRIPTION OF THE DRAWINGS

Various embodiments of the present invention are described in detail below with reference to the following drawings.

DETAILED DESCRIPTION

The present invention provides a blank and resulting container for holding any variety of goods. By way of overview and with references to FIGS. 1 through 4. An embodiment of the present invention includes a single piece blank 20 of foldable material arranged to form a container 60. Specific details of the blank 20 in container 60 are described with more particularity below.

Figure 1:
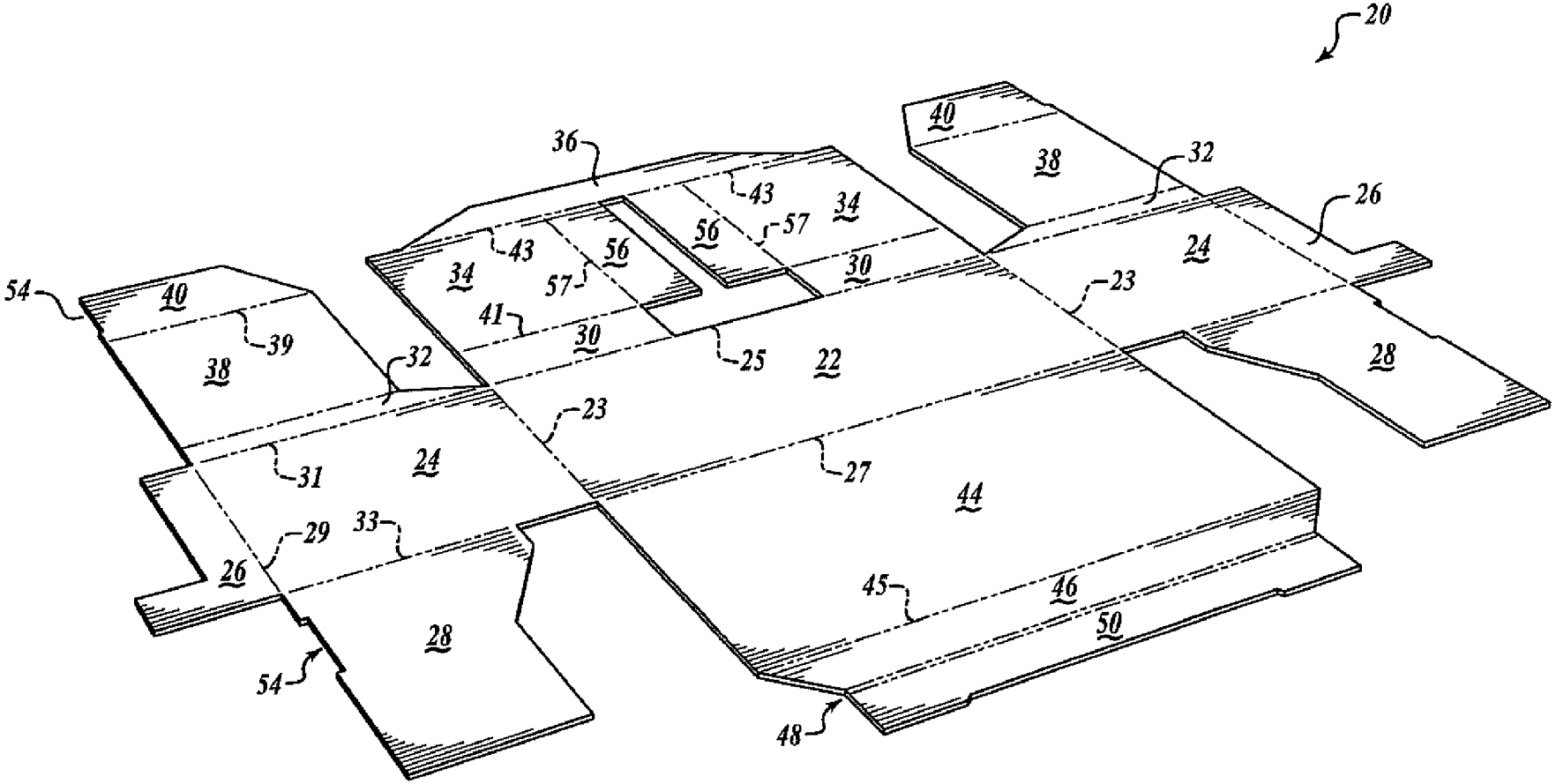
FIG. 1 is a plan view of a single piece of container blank formed in accordance with an aspect of the present invention.

FIG. 1 depicts a blank 20 used to form the container 60. The blank 20 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard. The blank 20 is cut and scored, perforated or otherwise formed to include a plurality of panels that when assembled form container 60. In all FIGURES, like numbers indicate like parts. Additionally, cut lines are shown as solid lines, score lines as dashed lines, and lines of perforation as broken lines.

With respect to FIG. 1, the blank includes an outer back panel 22, opposed outer side panels 24 and outer front flaps 26. The outer back panel 22 is generally rectangular or square in shape and is connected with the outer side panels 24 along a fold line 23. The outer back panel 22 is also connected with a rear top panel 30 along a fold line 25, and with an outer bottom panel 44 along a fold line 27. As depicted in the FIGURE, fold line 23 is substantially perpendicular to fold line 25. The intersection of the respective fold lines 23 and 25 substantially define the corner of the outer back panel 22.

An outer side panel 24 is generally rectangular or square in shape. The length of the outer side panels 24 measured along fold line 23 is substantially equal to the length of the outer back panel 22 measured along the same fold line.

Outer front flap 26 is generally L-shaped and is connected with the outer side panel 24 along fold line 29. The length of the outer front flap 26 measured along fold line 29 is substantially equal to the width of the outer side panel 24 measured along the same fold line. However, an outer front flap that is shorter than the outer side panel 24 when measured along fold line 23 is considered within the scope of this aspect of the invention.

Inner bottom panel 28 is connected with the outer side panels 24 along fold line 33. The length of the outer side panels 24 measured along fold line 33 is generally greater than the length of the inner bottom panel 28 measured along the same fold line. Inner bottom panel 28 may include cutout 54 formed in a periphery of the panel. Likewise, inner bottom panel 28 may have a profile such that the width of the panel measured in a directed parallel to fold line 33, and at the fold line 33 is not equal to the width measured a distance perpendicular to fold line 33.

Top side panel 32 is connected with the outer side panels 24 along fold line 31. Also an inner side panel 38 is connected with the top side panel 32 along a fold line 35, which is opposite the outer side panel 24. The length of the outer side panels 24 measured along fold line 31 is generally greater than the length of the top side panel 23 measured along fold line 35.

Connected with the inner side panel 38 along a fold line 39 is an inner side panel flap 40. In overall shape, the inner side panel flap 40 is similar in partial profile to a portion of the inner bottom panel 28, however, their relative overall sizes may be either the same or different. It will be appreciated that the cutouts 54, or portions thereof, if present, will be at least partially aligned once the container 60 is erected as disclosed below.

Inner back panels 34 are generally rectangular or square in shape. The inner back panels 34 are connected with the rear top panel 30 along a fold line 41. The length of the inner back panel 34 measured along fold line 41 is than the length of the outer back panel 22 measured along fold line 25. Additionally, an inner back panel flap 36 is connected with both of the inner back panels 34 along a fold line 43. Generally, the inner back panel flap 36 is trapezoidal in shape, however it will be appreciated that it my have other geometries as well.

Connected with each of the inner back panels 34 are back panel flaps 56. The back panel flaps 56 are connected with the inner back panels 34 along fold lines 57. Generally, the back panel flaps 56 are rectangular or square in shape, with their ultimate geometry being a function of container design.

Figure 2:
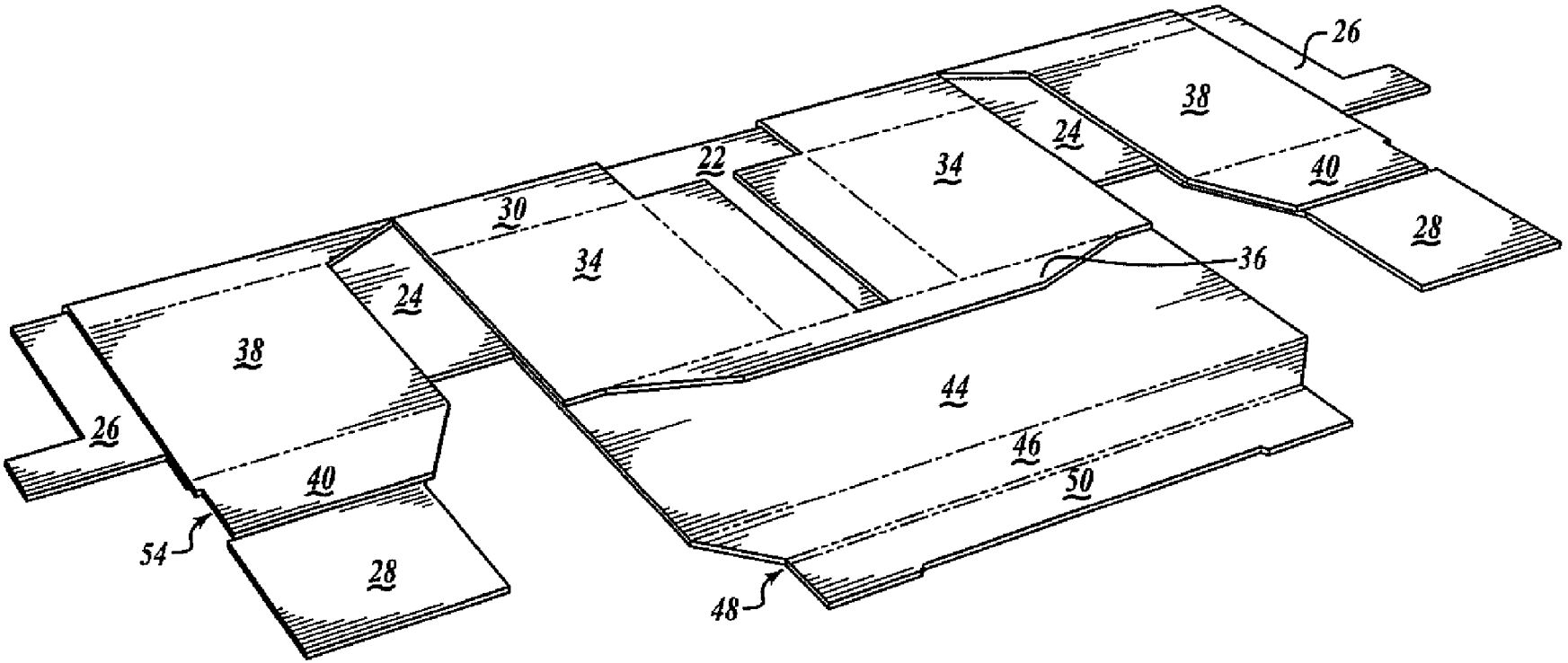
FIG. 2 is a perspective view of a partially assembled container assembly according to an aspect of the present invention.
Figure 3:
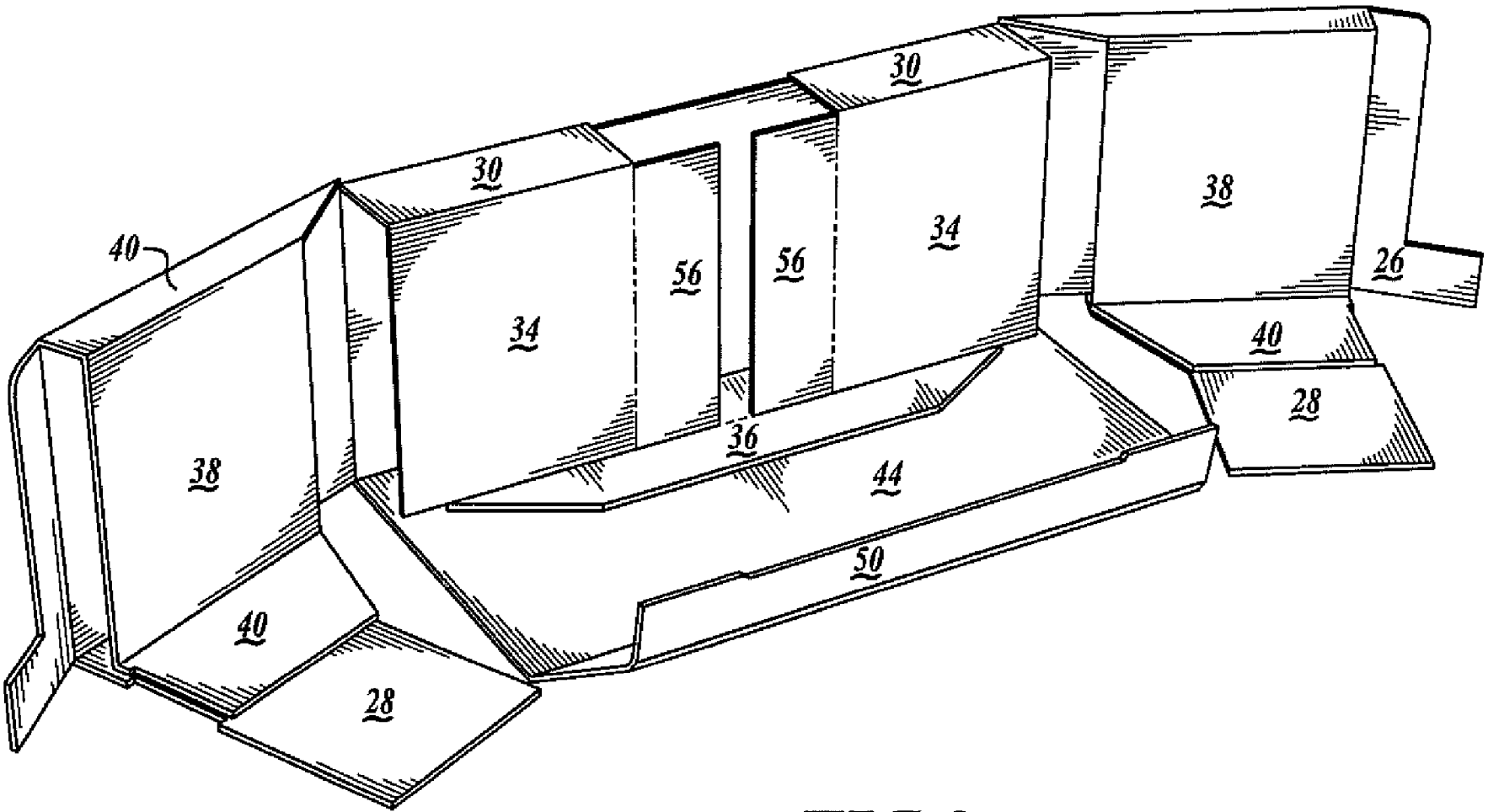
FIG. 3 is another perspective view of a partially assembled container assembly according to yet an another aspect of the present invention.
Figure 4:
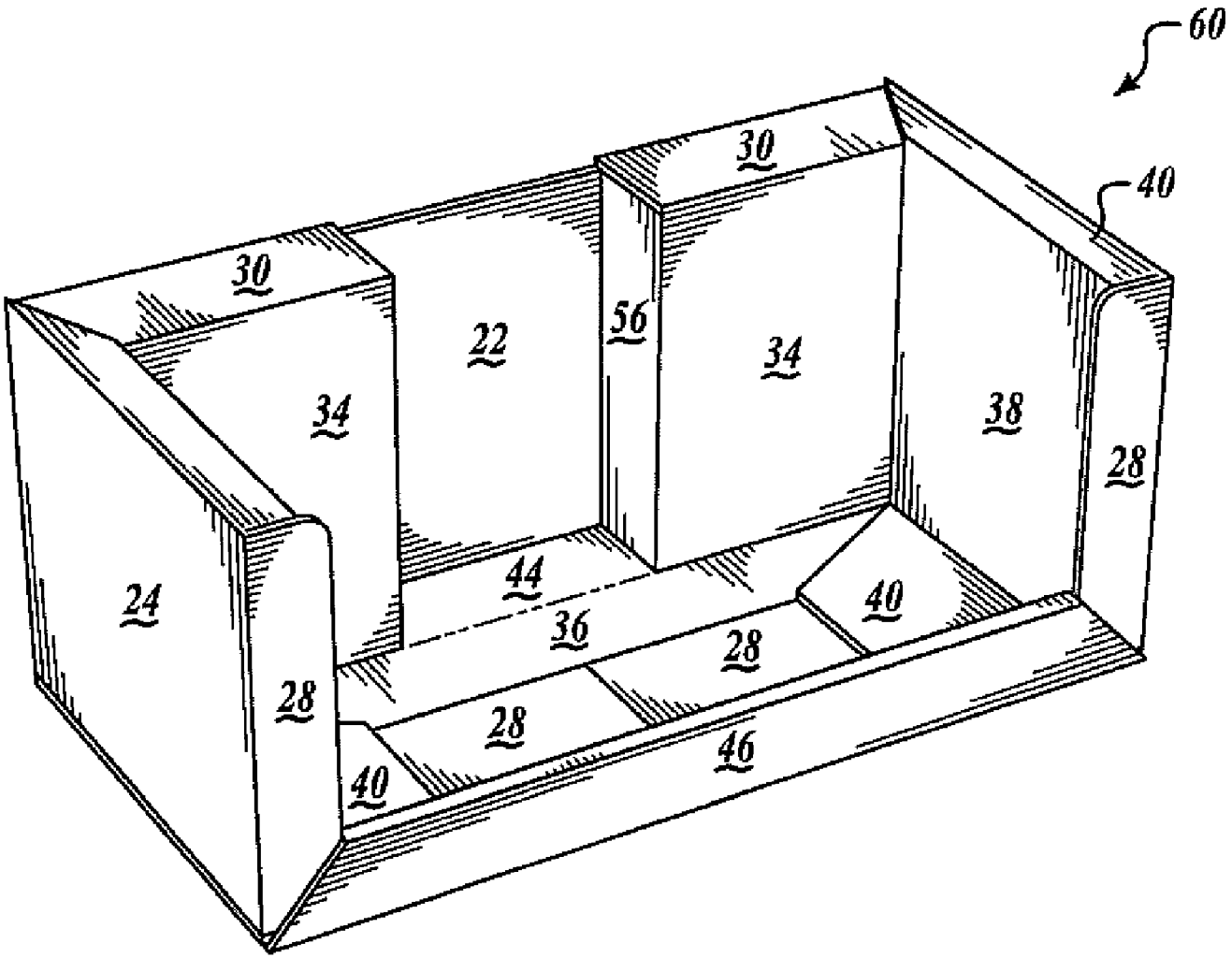
FIG. 4 is a perspective view of the assembled container blank of FIG. 1.

In order to further illustrate the various aspects about the embodiments, FIGS. 2 through 4, depict the blank 20 being erected into container 60. Typically, this is a hand-set container 60. However, it will be understood that mechanical box erecting equipment may be used in the erection of the container 60. As mechanical box erecting equipment is well know in the art a detailed description of such equipment is not necessary to understand the spirit and scope of the embodiments contained herein. Typically, this container 60 will use a combination of mechanical box forming equipment and hand set forming, as is discussed in more detail below.

With specific reference to FIG. 2, blank 20 is folded inwardly approximately 180 degrees along fold lines 31 and 25. In doing so, the inner side panels 38 and top side panel 30 are juxtaposed the outer side panel 24. Likewise, the inner back panel 34 and rear top panel 30 are juxtaposed the outer back panel 22. Also, the various inner side and back panels 38 and 34, respectively, are arranged such that inner side panel flap 40 is juxtaposed and aligned with inner bottom panel 28. Also, inner back panel flap 36 is juxtaposed a portion of the outer bottom panel 44.

At this point the respective panels and flaps may be glued where needed and shipped in the flattened state. This aspect allows for partial assembly of the boxes to be shipped efficiently. Once the partially assembled container arrives at a final destination, they may be finally assembled and used.

The erection process continues with folding the various panels around fold line 23, as best seen in FIG. 3. This move puts the inner bottom panels 28 juxtaposed the outer bottom panel 44. This double bottom panel arrangement provides considerable strength to the final container 60.

Outer front panel 46 may them be folded upwardly approximately 90 degrees along fold line 27. Subsequently, the inner front panel 50 may be folded downwardly about spaced apart fold line 48, trapping the projection portion of outer front flap 26 between the inner front panel 50 and outer front panel 46. As best seen in FIG. 4, the inner front panel 50 may be locked in place by any variety of means, including locking tabs, fasteners or adhesives (not shown). Likewise, back panel flaps 56 may be folded outwardly approximately 90 degrees. The container 60 is now ready for use.

The inner and outer side and back panels being separated by the rear top panel 30 and top side panel 32 form "air cells" between the respective inner and outer panels. Those skilled in art will appreciate that the respective size of the rear top panel 30 and top side panel 32 may be varied to achieve air cells of differing size. Thus, for a single outer container volume, any variety of inner container volume may be achieved. Having a container design with a constant outer box volume yet variable inner box volume serves to, among other things, maximize pallet space usage regardless of the overall geometry of the product being placed in the container 60. Also, the variable top, side, and rear panel size provides additional bearing surface and stability when stacking the containers 60 vertically. Further, it will be appreciated that this one piece design does not require additional corrugated inserts typically required for additional stacking strength, and/or void fillers.

The container 60 as shown is simple to manufacture, easy to assemble and may be a design of considerable usage in club stores or bulk stores where products are sold in large quantities on the open floor. However, this design is also useful in any variety of retail or wholesale environments. It is display ready once formed.

While various embodiments of this invention have been illustrated and described, as noted above, many changes can be made without departing from the spirit and scope of this invention. Accordingly, the scope of the invention is not limited by the disclosure of the various embodiments. Instead, the invention should be determined entirely by references to the claims that follow.

What is claimed is:

1. A single sheet of foldable material cut and scored to define a container, the container comprising:

an outer bottom panel;

an inner bottom panel juxtaposed a portion of the outer bottom panel;

an outer back panel connected with the outer bottom panel;

an outer side panel connected to the outer back panel and to the inner bottom panel;

a top side panel connected to the outer side panel;

an inner side panel connected to the top side panel;

rear top panels connected with the outer back panel;

a first inner back panel and a second inner back panel, each being connected with a respective one of said rear top panels along a first fold line;

wherein the top side panel and the rear top panels form air cells between respective of said inner and outer side and back panels and wherein each of the air cell dimensions being defined by sizes of the top side panel and the rear top panels;

a first back panel flap connected with the first inner back panel along a second fold line such that the first back panel flap extends between, and substantially normal to, the outer back panel and the first inner back panel; and a second back panel flap connected with the second inner back panel along a third fold line such that the second back panel flap extends between, and substantially normal to, the outer back panel and the second inner back panel;

wherein the first inner back panel is spaced from the second inner back panel along the first fold line, a distance that is greater than twice the perpendicular distance between the first inner back panel and the outer back panel.

2. The container of claim 1, wherein the single sheet of foldable material is formed from a cellulose-based material.

3. The container of claim 2, wherein the cellulose based material is formed from at least one of a wood pulp, straw, cotton, and bagasse.

4. The container of claim 2, wherein the cellulose based material is in the form of at least one of a fiberboard, containerboard, corrugated containerboard and paperboard.

* * * * *